US005183453A

United States Patent [19]

Yamashiro

[11] Patent Number: 5,183,453

[45] Date of Patent: Feb. 2, 1993

[54] UNIDIRECTIONAL FLUID FLOW RESISTED EXERCISE DEVICE WITH INERTIAL AND ELASTIC MECHANICAL LOADING

[76] Inventor: Patsy K. Yamashiro, 9918 NE. 116th St., Kirkland, Wash. 98034

[21] Appl. No.: 788,129

[22] Filed: Nov. 5, 1991

[51] Int. Cl.[5] ..... A63B 21/008

[52] U.S. Cl. ..... 482/112; 482/58

[58] Field of Search ..... 482/111, 112, 113, 57, 482/58, 63, 91; 128/25 R, 25 B

[56] References Cited

U.S. PATENT DOCUMENTS 3,387,843 6/1968 Chandler ..... 482/113
4,946,162 8/1990 Lubie .
4,979,734 12/1990 Sims .
4,979,735 12/1990 Stewart .
5,026,046 6/1991 DeCloux ..... 482/113

*Primary Examiner*—Stephen R. Crow

[57] ABSTRACT

Exercise apparatus wherein subject constraints such as supine position or joint stress can be accommodated to permit the maximum achievable exercise level. Provision for simulating limb muscle contraction for postural upright support is made through the use of elastic actuating members while in a non-standing position. Joint stress limitation can be accomplished by selection of the elasticity of these members. Apparatus materials and configuration can be selected to minimize interference in a magnetically sensitive enviornment to permit diagnositc biomagnetic imaging during exercise stress testing.

3 Claims, 2 Drawing Sheets

UNIDIRECTIONAL FLUID FLOW RESISTED EXERCISE DEVICE WITH INERTIAL AND ELASTIC MECHANICAL LOADING

BACKGROUND

1. Field of Invention

This invention relates to exercise apparatus, specifically as an improved means of applying a mechanical load such that subject constraints such as supine position or total force can be accommodated to allow the maximum possible exercise level to be achieved.

2. Description of Prior Art

Heretofore, exercise apparatus have not taken into account the effect of subject constraints such as posture or maximum permissible stress on a joint. Consequently, exercise performance under constrained conditions suffer significantly. This leads to the inability of reaching target heart rate levels for physiological stress testing especially when exercise must be performed in the supine position. Exercise testing in the supine position is required during magnetic resonance imaging (MRI) and biomagnetic imaging using superconducting quantum interference devices (SQUID). Both tests are used for diagnosing cardiovascular diseases and currently available exercise devices cannot be used due to unacceptable interference with the magnetically sensitive environments or poor subject tolerance leading to inability to reach target heart rate levels.

OBJECTS AND ADVANTAGES

Accordingly, to conduct cardiovascular stress testing during MRI or SQUID diagnostic imaging a magnetically optimized exercising device is needed which is constrained to the supine position, leg exercise, and capable of achieving exercise levels (heart rate) consistent with present standards. The present invention was designed to fill this need.

Another object of the present invention is to provide exercise for rehabilitation of patients following orthopedic surgical procedures. Following procedures like artificial hip or knee replacement, regular walking type exercise is required as soon as possible following surgery. A supine exerciser such as the present invention can be used to provide a walking type exercise with controlled joint stresses. The primary advantage is the safety of the supine position while allowing for re-training of the limb muscles under controlled conditions. Use of simple mechanical loads like springs or weights which are currently in use do not simulate loads encountered during walking very well. The mechanical load applied by the present invention can be adjusted to best simulate walking or jogging.

SUMMARY OF THE INVENTION

The present invention provides for the above-stated objectives as well as others by providing an exercise apparatus which is primarily intended to be used for leg exercise in the supine position, but can also be used for arm or leg exercise in other postures.

The exercise apparatus provided for herein comprises a pair of diaphragm hydraulic pumps each actuated with a flexible rod and foot pedal. Pumps are fitted with inlet and outlet flap valves and connected to a special hydraulic circuit which provide resistive and inertial mechanical loading. Circuit resistance is adjustable by varying the orifice size of a gate valve. Inertial load is set by the pump stroke volume and physical characteristics of the hydraulic circuit. The flexible rod connecting the foot pedal to each pump represents an elastic load component which is critical to the objectives of this invention.

The pumps and hydraulic circuit are arranged such that when both pumps are equally pressurized, no fluid movement is allowed and a stable reference level is provided. This allows the establishment of an isometric phase of leg muscle activation similar to what occurs naturally with leg muscles contracting to maintain a standing posture. With the present device, leg muscle contraction at the stable reference level can be varied by the degree of deflection of the flexible rods. The choice of rod flexibility also provides a means of limiting the force transmitted to the limb joints.

In normal operation the two pumps are operated sequentially with one unit pumping while the other is filled. Exercise involves pushing and pulling on the pump diaphragms through the elastic rods. Either or both modes can be used depending on subject preference. Use of the pulling mode can be accomplished with straps mounted on the foot pedals.

One of the primary advantages of the present apparatus is the capability to simulate the mechanical loading conditions of normal upright walking or jogging while in the supine position. As described above, the effect of gravity and isometric muscle contraction can be simulated. The degree of elasticity is easily adjusted by using rods of different composition to obtain a similar effect as stepping using cushioned athletic shoes. The primary adjustable load element is resistive through a variable orifice valve. Mechanical inertia imparts a desirable feel of stability to exercise apparatus, but usually introduces a hazard during dismounting. This is avoided in the present design by use of hydraulic inertia to provide a smooth stable feel. The unique feature here is that interruption of pedal movement can be made at any time without encountering any mechanical inertial hazard such as a rotating flywheel.

Another advantage of this invention is the feasibility of attaining stress test levels of exercise without involving motion of the upper body. This makes this design feasible for use during MRI and SQUID diagnostic testing of physiological function. The present apparatus can be fabricated entirely of non-magnetic materials and can be configured for minimizing disturbance of such magnetically sensitive environments especially in the vicinity of the thoracic cavity or brain. This is accomplished by co-ordinating magnetic sensor direction and location and orientation of exercise apparatus components for minimum disturbance. The highly directional characteristic of magnetic fields and their generation is exploited for this purpose.

Various other objects, advantages, and features of the invention will become apparent to those skilled in the art from a consideration of the drawings and ensuing description of it.

DESCRIPTION OF THE PREFERRED EMBODIMENTS

Figure 1:
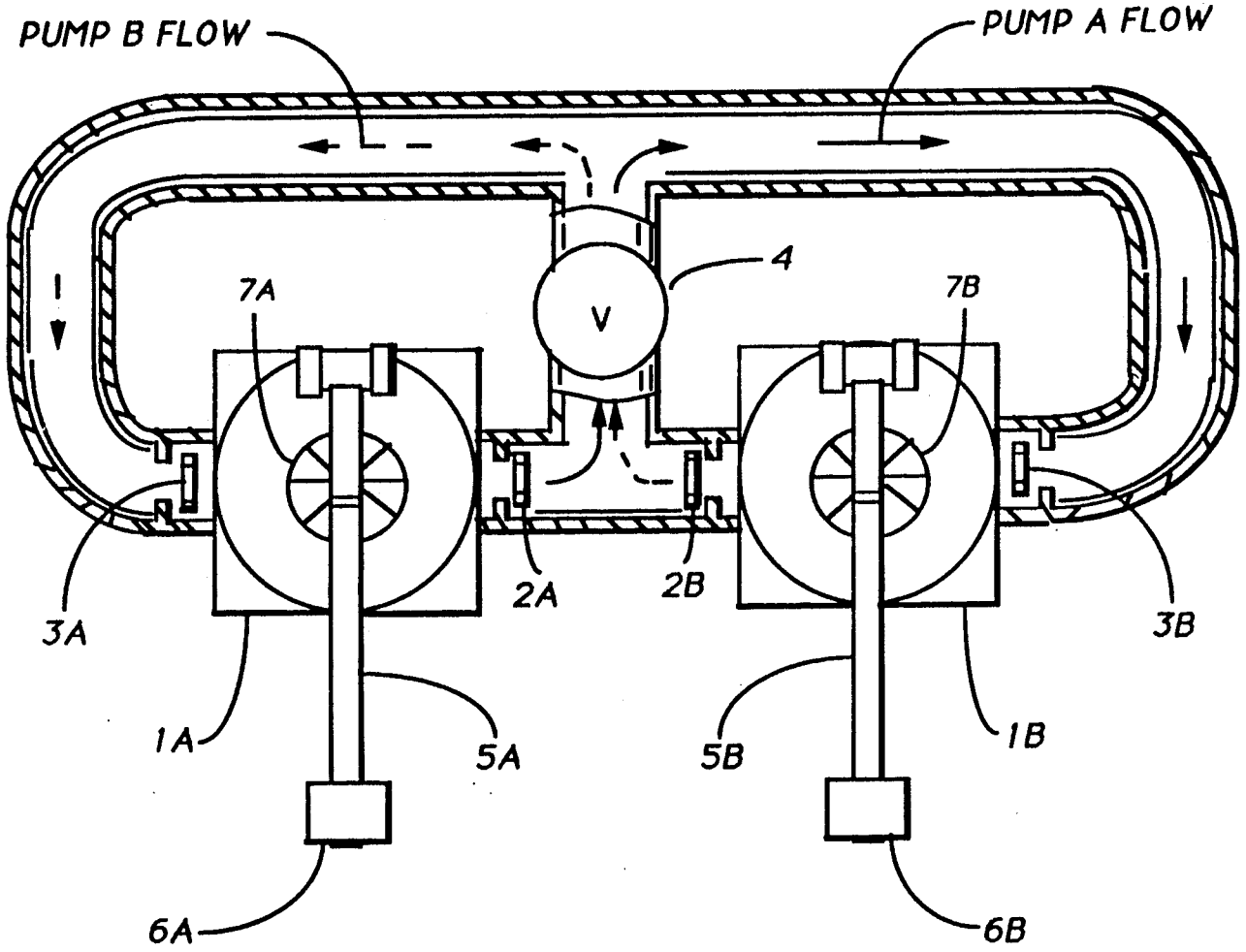
FIG. 1 is a schematic drawing of the hydraulic circuit used in the invention apparatus.

Referring to FIG. 1, the hydraulic circuit of the inventive exercise apparatus is illustrated. Diaphragm pumps 1A and 1B are fitted with unidirectional flap valves 2A, 2B, 3A, and 3B which serve to direct flow through the circuit. Valves 2A and 2B direct flow out and valves 3A and 3B into each respective pump. One commercially available pump which can be utilized for this purpose is the Model BP4402 manually operated marine bilge pump available from Munster Simms Engineering Limited. In normal operation, one pump will be actuated or pressurized while the other depressurized. Fluid flow will then be directed from the pressurized to the de-pressurized pump through variable orifice gate valve 4. Valve 4 is used to adjust the level of viscous resistance encountered by fluid flow and thus the level of exercise. A sequence of alternating pump pressurization followed by depressurization is intended such that fluid will flow from one pump to the other in a continuous "figure 8" pattern. A key feature of the hydraulic circuit is the cessation of fluid flow and immobilization of both pump diaphragms when both pumps are equally pressurized. This allows for isometric(constant length) conditions where exercise can be accomplished by pushing or pulling on the flexible rods connecting each foot pedal to the pump diaphragm.

Figure 2:
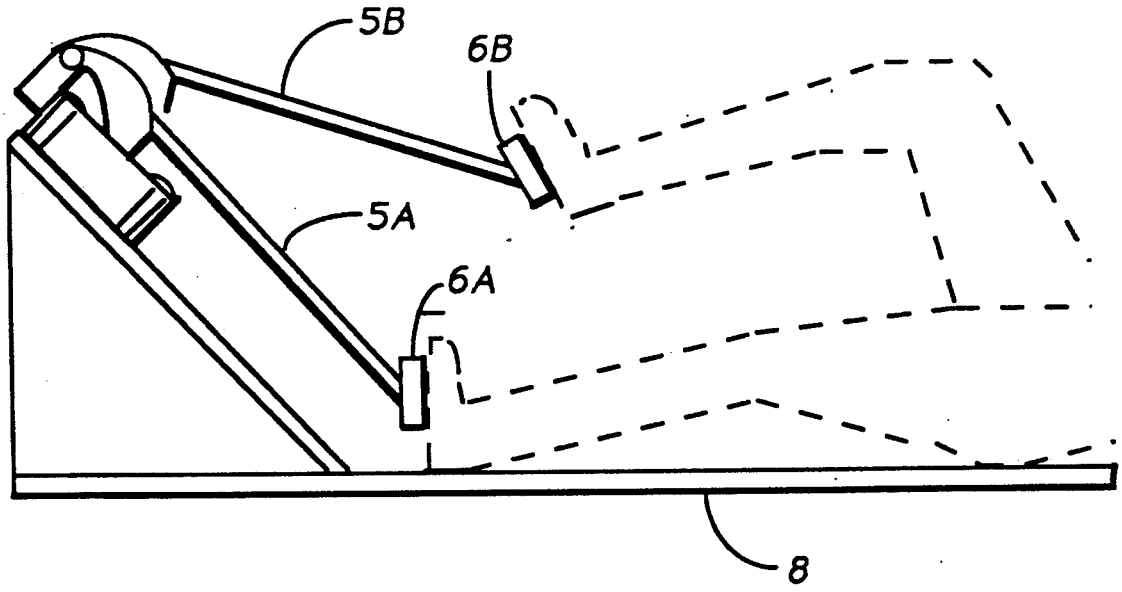
FIG. 2 is a schematic side view showing the arrangement of the exercise apparatus as set up for a supine exercising subject.

FIG. 2 shows the relationship between the diaphragm pumps, flexible rods 5A and 5B, and foot pedals 6A and 6B. Each diaphragm pump is pressurized by movement of a circular shaped disc 7A or 7B (FIG. 1) which is coupled to flexible rod 5A or 5B. The disc is sealed to the pump body with a flexible joint. When both pumps are equally pressurized, both pump discs 7A and 7B become immobilized and pushing or pulling on the foot pedals will cause bending of the flexible rods 5A and 5B. This permits isometric leg exercise to be performed along with exercise associated with movement of fluid. By proper choice of rod elasticity and degree of flexion isometric leg muscle contraction associated with maintaining a standing posture can be simulated while in the supine position. Another useful feature of this apparatus is the ability to limit the maximum force applied by each limb for a given limb excursion again by choice of rod elasticity. Rods of different elasticity can be made by choice of material. The material property most important for this purpose is flexural modulus. A flexural modulus of 480,000 psi corresponding to polyetherimide resin rod is suitable for low level normal exercise. These rods are available with various amounts of glass fiber filling for stiffening. A 30% glass filled polyetherimide resin rod has a flexural modulus of 1,300,00 psi and would be suitable for heavy exercise. For limitation of force, other materials such as unfilled polycarbonate resin can be used which has approximately half the flexural modulus of polyetherimide.

FIG. 2 shows the support structure of the inventive apparatus when used in the supine position. The subject, schematically represented lies in a supine position on platform 8 to which the exercise apparatus is attached. The subject legs are shown positioned on foot pedals 6A and 6B. This arrangement utilizes the subject weight to stabilize the support structure which then need not be further anchored. For exercise levels consistent with cardiovascular stress testing, no special supports are needed between the subject and the platform 8 except for a non-slip pad. A natural walking action is promoted by the arrangement of pedals which allow a fully extended position of one foot while the other foot is raised forward to take another step. Note that isometric muscle contraction of the extended foot simulating gravitational postural support in the standing position is accomplished through flexion of rod 5A. No foot strap is shown in FIG. 2 since this better simulates natural walking. However, a foot strap can be used to increase the work load to include pulling on the pump rods.

While the above description contains many specificities, these should not be construed as limitations on the scope of the invention, but as an exemplification of one preferred embodiment thereof. Many other variations are possible. For example, the foot pedal arrangement shown in FIG. 3 are depicted as having the major axis of the flexible rods 4A and 4B perpendicular to the ground level. The rods could also be arranged with their major axes parallel to the ground plane. This would be the preferred arrangement for using the exercise apparatus for arm exercise and a rowing type action. Also, this might be a preferred mode for leg exercise if equipment constraints during diagnostic stress testing preclude the depicted arrangement shown in FIG. 2 Accordingly, the scope of the invention should be determined not by the embodiments illustrated, but by the appended claims and their legal equivalents.

I claim:

1. Exercise apparatus comprising a pair of actuated hydraulic diaphragm pumps with flexible interconnecting members linking said diaphragm pumps to foot pedals with provision for providing resistive, inertial, and elastic exercise mechanical loads simultaneously;

each of said pumps fitted with inlet and outlet unidirectional flow valves connected to a closed hydraulic circuit with both pump outlets joined together prior to connection to a common adjustable resistance orifice comprising the resistive exercise load;

wherein fluid passage through said resistance orifice is directed to the inlets of both said pumps which are connected together;

said hydraulic circuit incorporates an inertial exercise load formed by the mass of fluid moved per pump stroke as well as physical shape and dimension of the circuit conduits to provide load stability;

whereby said closed hydraulic circuit provides unidirectional flow through said adjustable resistance as both pumps are alternately activated by the exercising subject;

whereby equal activation of both said pumps leads to cessation of flow and the establishment of a means for exercise through flexion of said flexible interconnecting members which constitutes the elastic exercise load;

whereby said elastic load provides a means of simulating limb muscle contraction to maintain a standing posture while exercising in a non-standing posture.

2. The exercise apparatus of claim 1, wherein said flexible interconnecting members are used as a means of limiting the maximum force imparted to subject limbs and consequently the maximum stress on joints.

3. The article of claim 1, wherein construction materials and arrangement of components are specifically chosen to minimize exercise induced magnetic field disturbances in specific regions of the body.

* * * * *